US006368254B1

(12) United States Patent
Wall

(10) Patent No.: US 6,368,254 B1
(45) Date of Patent: Apr. 9, 2002

(54) HYBRID STRETCHING AND EXERCISING MACHINE

(76) Inventor: Robert A. Wall, 5430 Donna Dr., Tarzana, CA (US) 91356-3204

( * ) Notice: Subject to any disclaimer, the term of this patent is extended or adjusted under 35 U.S.C. 154(b) by 0 days.

(21) Appl. No.: 09/418,548

(22) Filed: Oct. 14, 1999

(51) Int. Cl.[7] ..... A63B 21/02; A63B 22/00

(52) U.S. Cl. ..... 482/71; 482/51; 482/907; 482/122

(58) Field of Search ..... 482/51, 52, 70, 482/71, 121–123, 96, 95, 126, 148, 907

(56) References Cited

U.S. PATENT DOCUMENTS 4,781,372 A * 11/1988 McCormack ..... 272/70
4,826,158 A * 5/1989 Fields, Jr. ..... 272/144
5,279,532 A * 1/1994 Chen ..... 482/71
5,328,427 A * 7/1994 Sleamaker ..... 428/71
6,042,523 A * 3/2000 Graham ..... 428/121
6,071,217 A * 6/2000 Barnett ..... 428/121

* cited by examiner

*Primary Examiner*—Stephen R. Crow
(74) *Attorney, Agent, or Firm*—Stetina Brunda Garred & Brucker

(57) ABSTRACT

Hybrid stretching and exercising machine. The machine comprises first and second elongate track members having proximal and distal ends ranged in a co-linear fashion. First and second foot-receiving members are slidably and rotatably mounted upon respective ones of the track members, and are further inwardly biased toward the respective proximal ends thereof. Preferably, the degree of bias may be selectively controlled. In use, the user is able to rapidly stretch and strengthen the muscles of both right and left legs by merely twisting about the device by approximately 180°. The device further preferably includes a handle member to provide support during use of the device, and may be further adapted to enable the user to perform rowing, curl, and abdominal-strengthening type exercises.

14 Claims, 5 Drawing Sheets

HYBRID STRETCHING AND EXERCISING MACHINE

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

In order to optimally exercise and excel in sports, it is necessary for one to possess not only strength and stamina, but flexibility as well. In this regard, virtually every sport places demands on its participants to move and contort body in ways in which it is generally not accustomed. Indeed, certain sports, and in particular the martial arts, demand a tremendous degree of flexibility in the muscle groups of the participants' legs. As it is well-known, the martial arts extensively incorporate a variety of kick-type movements that require proper rotation of the body and extension of the legs, as well as the ability of the participants to rapidly shift their weight from one leg to another, as must accompany such movements. Moreover, because of the intense and rapid kicking movements that are made in anticipation of reaction to an opponent's movements, such high degree of flexibility must be optimally maintained at all times.

Notwithstanding the demands placed upon individuals who exercise or participate in sports, and particularly athletes who participate in martial arts, there is currently lacking in the art any type of stretching device that develops and improves flexibility of the legs, and more particularly the soleus, gastrocnemius, semitendinosus, biceps, femoris, rectus femoris, gracilis, adductor longus, adductor magnus, and vastus medialis muscles thereof. There is further lacking in the art any such device that, in addition to improving flexibility, further strengthens and tones such muscle groups.

In this regard, most exercise devices currently available are directed either toward developing strength or cardiovascular endurance. With respect to the former, such exercise devices typically comprise of either free weights or weight machines that target certain muscles or muscle groups sought to be strengthened. Cardiovascular machines, in contrast, typically comprise stationary machines such as treadmills, stair climbers, rowing machines, and stationary bicycles. While generally effective at increasing cardiopulmonary conditioning by increasing the heart rate and lung capacity, such device restricts the user thereof to engage in a single repetitious activity having a limited range of motion. As a consequence, such class of exercise equipment fails to place any emphasis on flexibility, let alone develop and strengthen muscles and muscle groups that necessarily must possess such degree of flexibility.

Accordingly, there is a need in the art for a stretching device that, in addition to developing strength and endurance, further develops and increases flexibility with respect to the legs and muscle groups thereof. There is further a need in the art for a stretching device which may further be utilized as a multi-use exercise machine capable of being utilized for a variety of strengthening exercises and cardiopulmonary conditioning.

Still further, there is a need for such stretching and exercise device that is easy to use, space efficient, of simple and durable construction, and relatively inexpensive to manufacture.

BRIEF SUMMARY OF THE INVENTION

The present invention specifically addresses and alleviates the above-identified deficiencies in the art. In this regard, the present invention is directed to a hybrid stretching and exercise machine that substantially increases flexibility and strength in a user's legs, and in particular the soleus, gastrocnemius, semitendinosus, biceps, femoris, rectus femoris, gracilis, adductor longus, adductor magnus, and vastus medialis muscles thereof that further can be utilized to perform a multiplicity of strengthening exercises. According to a preferred embodiment, the hybrid stretching and exercise machine comprises the combination of first and second elongate track members, each respectively having proximal and distal ends. The track members are arranged in a generally co-linear fashion such that the proximal ends thereof abut one another. A first foot-receiving member is rotatably and slidably mounted upon the first track member, and biased towards the proximal end thereof. A second foot-receiving member is likewise mounted upon the second track member. In use, when an individual stands upon the device such that each foot of the individual is secured within a foot-receiving member, the individual is enable to perform the "splits" and/or stretch out to assume a sprinter's "start" position by spreading the feet and legs apart against the biasing force imparted to the foot-receiving members and rotating the feet, legs, and torso to attain desired stretch and flexibility in opposed muscle groups, as may be accomplished via the rotational movement of the foot-receiving members upon the first and second track members.

In further refinements of the invention, the hybrid stretching and exercising device may be provided with a handle member, which may take the form of an elongate upright handle with hand grips, or alternatively, lower arcuate hand grips for those having a higher degree of flexibility. The device may further be modified to enable a user to perform abdominal-strengthening exercises, rowing-type exercises, and curl-type biceps strengthening exercises. With respect to abdominal strengthening exercises, the device may be manipulated such that a knee-rest cushion may be mounted upon a respective one of the first and second track members and a pair of handle grips slidably mounted upon the respective other track member. To perform such exercises, an individual need only position his or her knees upon the knee rest cushion and transition forward and backward between extended and contracted configurations as per conventional abdominal-strengthening exercises.

With respect to rowing exercises, the device may be modified such that a seat cushion is mounted upon a respective one of the track members and a handle member coupled to a biasing force disposed within the respective other track member, which preferably comprises an elastic cord, enabling a user to perform such exercises. Similarly, such handle member may be connected to the biasing force (i.e., an elastic cord) with the user assuming a standing position over the device. By performing the curl-type motion with the arms, the biasing force exerted by the biasing means against the handle thus facilitates and promotes biceps strengthening.

As per conventional exercise machines, the machine of the present invention may further be coupled with a timer or a calorimeter to enable the user to keep track of the duration of the given work out, as well as the number of calories expended during such workout.

It is therefore an object of the present invention to provide a hybrid stretching and exercise machine for developing and improving flexibility and strength.

Another object of the present invention is to provide a hybrid stretching and exercise machine that specifically facilitates stretching of the soleus, gastrocnemius, semitendinosus, biceps, femoris, rectus femoris, gracilis, adductor longus, adductor magnus, and vastus medialis muscles.

Another object of the present invention is to provide a hybrid stretching and exercise machine that enables the legs of an individual to assume exaggerated stretching configurations.

Another object of the present invention is to provide a hybrid exercising stretching machine that enables the muscles groups of each leg to be alternately stretched in a rapid and continuous manner.

Another object of the present invention is to provide a hybrid exercising stretching device that further facilitates the performance of abdominal-strengthening exercises.

Another object of the present invention is to provide a hybrid exercising stretching device that further facilitates the performance of rowing-type exercises.

Another object of the present invention is to provide a hybrid exercising stretching device that further facilitates the performance of curl-type biceps strengthening exercises.

Another object of the present invention is to provide a hybrid exercising stretching device that is of simple construction, inexpensive to manufacture, exceptionally durable, and is safe and easy to use.

BRIEF DESCRIPTION OF THE SEVERAL VIEWS OF THE DRAWING

These, as well as other features of the present invention, will become more apparent upon reference to the drawings, wherein.

DETAILED DESCRIPTION OF THE INVENTION

The following detailed description and the accompanying drawings are provided for the purpose of describing certain presently preferred embodiments of the invention only, and are not intended to limit the scope of the claimed invention in any way.

Figure 1:
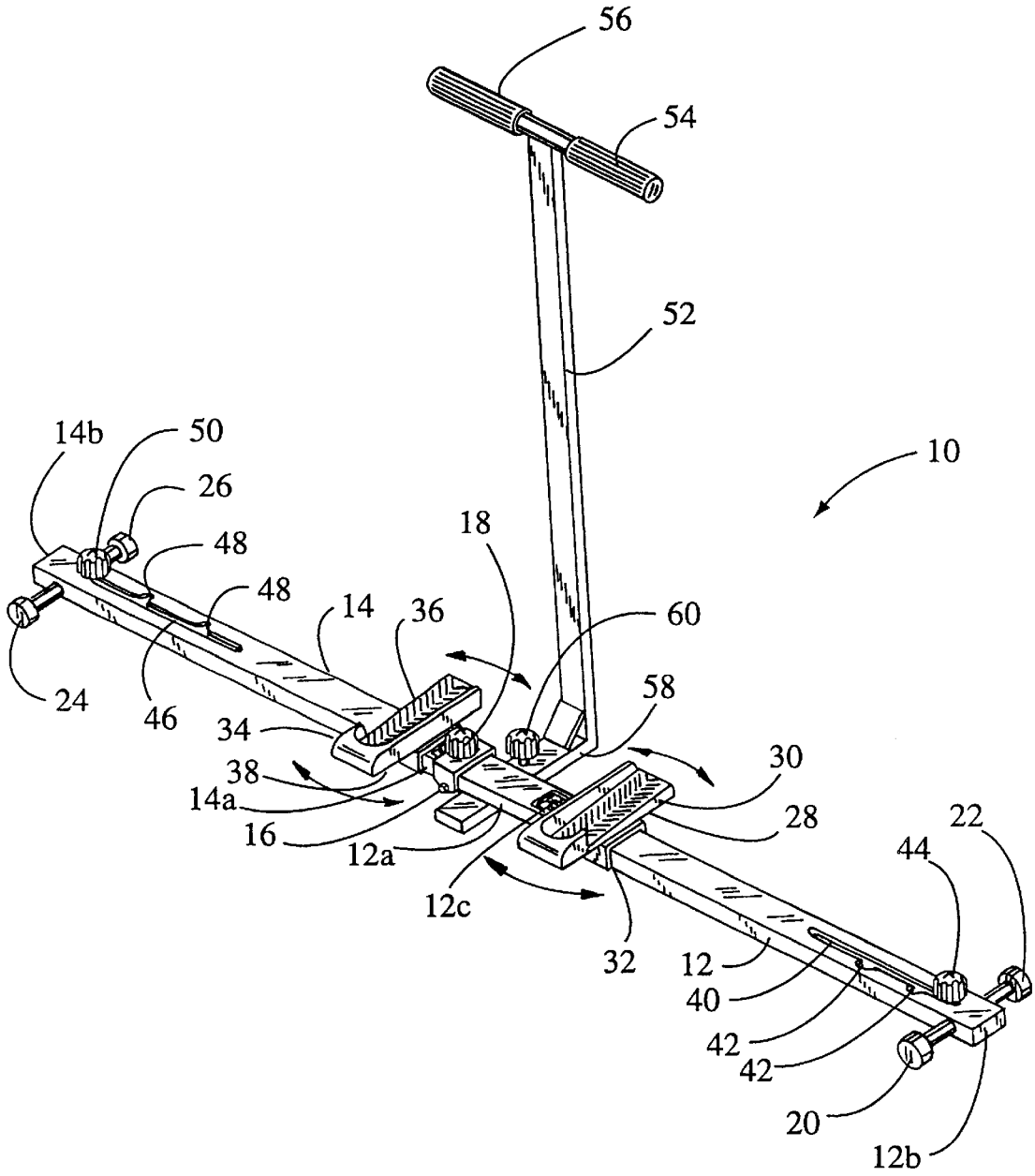
FIG. 1 is a perspective view of a hybrid stretching and exercise machine constructed in accordance with a preferred embodiment of the present invention.

Referring now to the drawings, and initially to FIG. 1, there is depicted a hybrid stretching and exercise machine 10 constructed in accordance with a preferred embodiment of the present invention. As illustrated, the machine 10 comprises the combination of first and second elongate track members 12, 14. Each respective track member 12, 14 is formed to have a proximal end 12*a*, 14*a* and a distal end 12*b*, 14*b*. The track members 12, 14 are arranged in a generally co-linear fashion such that the respective proximal ends 12*a*, 14*a* of the track members 12, 14 substantially abut one another. Preferably, the track members 12, 14 are connected at the proximal ends thereof via a hinge member 16 which enables the machine 10 to selectively transition between a first operative configuration, as shown, and a second collapsed, space-efficient configuration. With respect to the latter, such collapsed configuration enables the machine 10 to be easily stored and handled when the same is not in use.

To provide stability to the rail members 12, 14, there is preferably disposed at the respective distal ends thereof 12*b*, 14*b* stabilizer members 20, 22, 24, 26. Specifically, formed upon the distal end 12*b* of the first rail member 12 are support members 20, 22. Similarly, on the distal end 14*b* of the second rail member 14 are support members 24, 26. As will be recognized by those skilled in the art, and as is discussed more fully below, the support members 20, 22, 24, 26 enable the rail members 12, 14 to assume a substantially rigid elongate configuration to enable the machine 10 to be utilized.

To facilitate usage of the hybrid stretching and exercise machine 10 of the present invention, formed upon each respective rail member 12, 14 are dedicated foot-receiving members 28, 36. In this regard, there is specifically provided a first foot-receiving member 28 formed upon the first rail member 12 and a second foot-receiving member 34 formed upon the second rail member 14. The first and second foot-receiving members 28, 34 are further provided with foot-receiving surfaces 30, 36 formed respectively thereon. Such foot-receiving surfaces 30, 36 are preferably textured to provide a high degree of traction.

The foot-receiving members 20, 34 are rotatably mounted upon the respective track members 12, 14 such that the same may freely rotate thereon as shown. However, as may be desired in certain applications, the foot-receiving member 20, 34 may be formed to have a limited range at rotation. The first and second foot-receiving members 28, 34 are further mounted upon track mounts 32, 38, respectively, to thus enable the foot-receiving members 28, 34 to move along the length of the track members 12, 14. In this regard, track mount 32 enables the first foot-receiving member 28 to extend along the length of the first rail member 12, whereas mount 38 enables second foot-receiving member 34 to extend the length of the second track member 14.

According to a preferred embodiment, each foot-receiving member 28, 34 is biased inwardly to the respective proximal ends 12*a*, 14*a* of the track members 12, 14. The foot-receiving members 28, 34 are preferably biased via a biasing apparatus disposed within the respective track members 12, 14. Preferably, such biasing apparatus comprises a pair of elongate elastic cords (not shown) that are disposed within dedicated ones of the track member 12, 14. An opposed end of such cord is anchored to a foot-receiving member via an aperture, such as 12*c*, formed upon a track member, with the respective other opposed end of the cord being anchored to a biasing tension system. Preferably, such system comprises the combination of a knob member, such as 44 formed upon first rail member 12 or 50 formed upon second rail member 14, which is connected to the opposed end of such elastic cord. The knobs 44, 50 are disposed within unique tension selecting apertures 40, 46 formed upon dedicated ones of the track members 12, 14. Specifically, a first tension aperture 40 is formed upon the first track member 12 which enables the knob 44 to be selectively positioned upon the length thereof. In a more highly preferred embodiment, such slot 40 is provided with notches 42 that enable the knob 44 to be selectively positioned therein at select locations formed upon the notch 40.

As will be recognized by those skilled in the art, by manipulating the length of the elastic cord extending from the knob 44 to the foot-receiving apparatus 28, a desired degree of tension, namely, an enhanced bias toward the proximal end 12*a* of the first rail member 12, may be selectively controlled. An identical biasing arrangement is preferably provided on the second rail member whereby an elastic cord (not shown) is anchored at one end to the foot-receiving member 34 and the respective other end anchored to knob 50. Knob 50 may be selectively positioned upon the length of aperture 46 at select locations therealong. Notches 48 may be provided to enable the knob 50 to remain secured at specific lengths along the aperture 46 to thus create pre-selected degrees of tension and enhanced bias.

To facilitate use of the machine 10 of the present invention, the machine preferably includes a handle member 52 having hand grips 54, 56 formed thereon, which may be detachably fastened intermediate the first and second rail members 12, 14. Preferably, such handle member 52 may be rigidly affixed to the device at the juncture between the proximal ends 12*a*, 14*a* thereof. A knob fastener 60 is provided to enable the handle 52 to be rigidly secured to the device 10. It will be understood, however, that the handle member 52 may take any of a variety of forms well-known to those skilled in the art.

Figure 2:
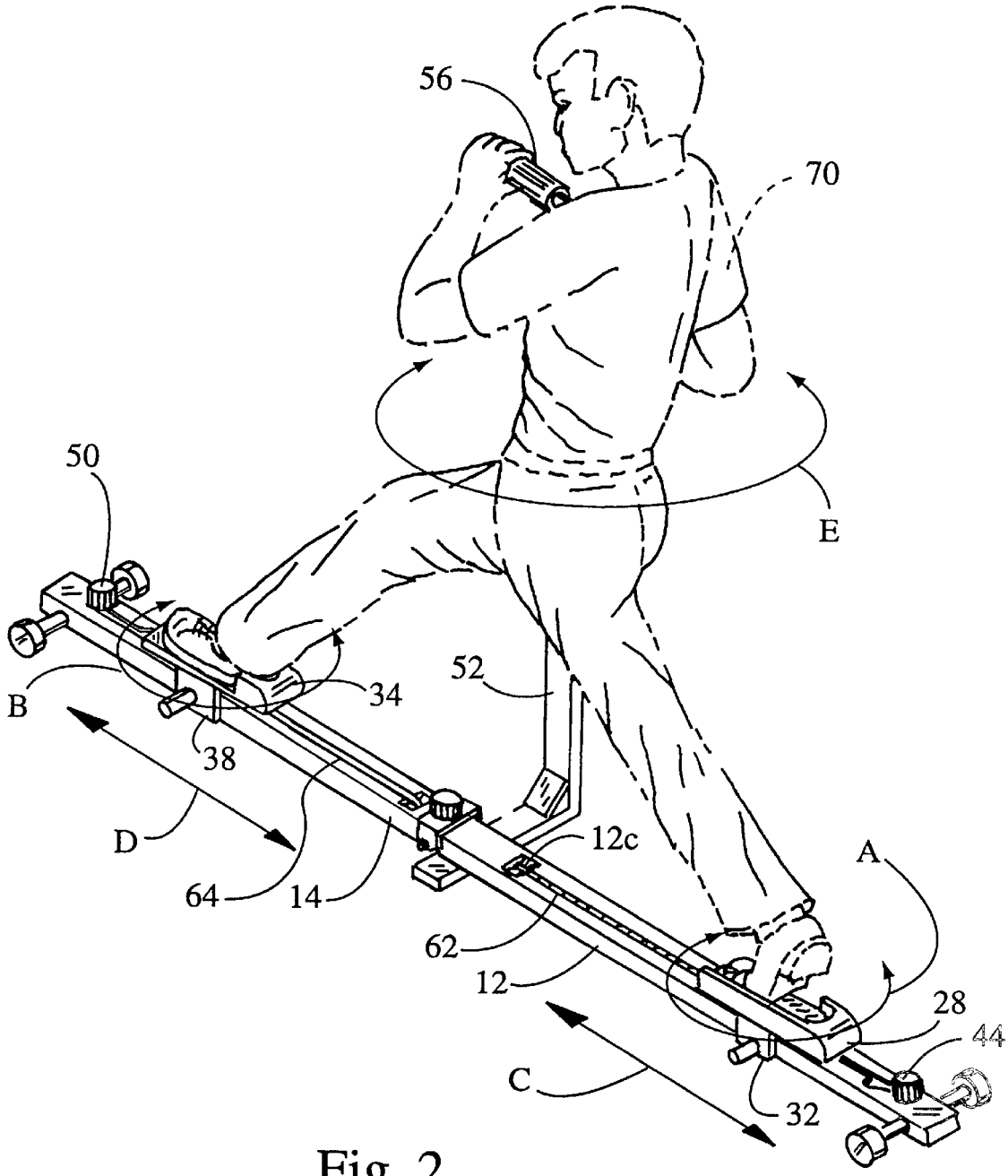
FIG. 2 is a perspective view of the hybrid stretching and exercise machine in FIG. 1 with an individual situated thereon performing leg stretching exercises.

Referring now to FIG. 2, there is shown an individual 70 depicted in phantom, utilizing the hybrid stretching and exercise machine 10 of the present invention. As shown, the individual 70 utilizes the device 10 by placing his or her feet within respective ones of the foot-receiving members 28, 34. The individual 70 then abducts his or her legs such that the individual's feet exert pressure against the inward biasing force produced by elastic cords 62, 64 to thus stretch and strengthen the individual's leg muscles, and in particular, the soleus, gastrocnemius, semitendinosus, biceps, femoris, rectus femoris, gracilis, adductor longus, adductor magnus, and vastus medialis muscle and muscle groups thereof. In this regard, the individual 70 is able to assume a "split" type position upon the device 10 of the present invention and, by virtue of the rotational movement provided for by the foot-receiving members 28, 34, can rapidly contort to thus assume a sprinter's stance facing either a right or left orientation.

As will be appreciated by those skilled in the art, the rotational movement of the first foot-receiving member 28 in the direction indicated by the letter A, and the rotational movement -of the second foot rest member 34 in the direction indicated by the letter B enables the individual 70 to rotate his or her body, and more particularly the torso thereof, in the direction indicated by the letter E to thus enable the individual to rapidly stretch and strengthen the vastus medialis, vastus lateralis, gracilis, pectineus, sartorius, rectus femoris, and adductor longus muscles and muscle groups in one leg and the biceps femoris, semitendinosus, gastrocnemius, adductor magnus, and peroneus brevis muscles and muscle groups of the other leg by simply and quickly rotating in an opposed direction, the individual's corresponding muscle groups in the respective other leg can rapidly be stretched and strengthened.

In order to facilitate such movement of the body, and more particularly the rotational movement of the feet in the directions indicated by the letters A and B and the torso in the direction indicated by the letter E, the machine 10 of the present invention allows each respective foot-receiving member 28, 34 to extend linearly along paths C and D, respectively. In this regard, first foot-receiving member 28 is free to extend linearly in the path indicated by the letter C and the second foot-receiving member 34 is extensible linearly in the path indicated by the letter D. Such linear movement enables the individual 70 to progressively develop greater flexibility over time. Moreover, due to the inward bias of the foot-receiving members 28, 34 towards the proximal ends of the first and second track members 12, 14, exertion by the individual's legs towards the distal 12*b*, 14*b* of the first and second track members 12, 14 promotes and increases the strengthening in the legs.

Figure 4:
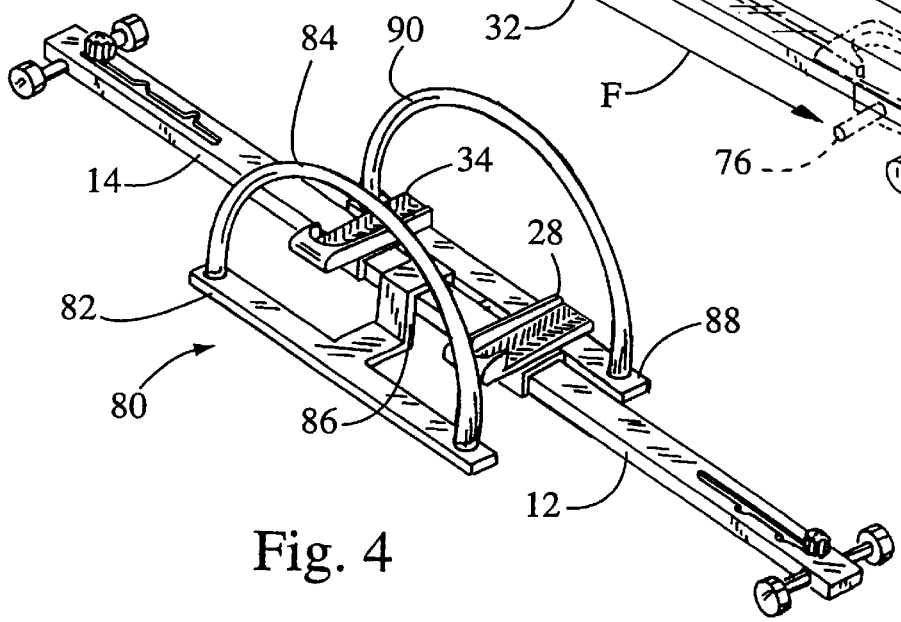
FIG. 4 is a perspective view of the hybrid stretching and exercise machine of FIG. 1 having a second handle configuration formed thereon, the latter constructed in accordance with a second preferred embodiment of the present invention.

For those individuals already possessing a substantial degree of flexibility and strength in the legs, there is provided in FIG. 4 an alternative configuration of a handle 80 to be utilized with the hybrid stretching and exercising machine 10 of the present invention. As per the first embodiment, the handle system 80 is configured to be disposed intermediate the juncture between the first and second track members 12, 14. Unlike the first embodiment, however, the handle system 80 is provided with low-profile, arcuate hand-rail members 84, 90 that extend across opposed sides of the device 10. In this regard, such arcuate hand-rail members 84, 90 are preferably formed respectively on base portions 82, .88 to thus provide stability to such handle members 84, 90 when grasped by a user. Central mounting member 86 is provided to provide secure attachment at a specific site along the first and second rail members 12, 14. As will be appreciated by those skilled in the art, the lower profile handles 84, 90 will be particularly useful for those well-trained in the martial arts that have already developed a substantial degree of flexibility in the legs.

In addition to functioning as a stretching machine to increase the flexibility and strength of the legs, the machine 10 of the present invention may further be adapted to enable an individual to perform a variety of exercises to increase overall strength and cardiovascular conditioning. In this regard, the hybrid stretching and exercise machine 10 of the present invention further may be utilized to perform abdominal strengthening exercises, rowing exercises, and curl-type exercises for strengthening the biceps.

Figure 3:
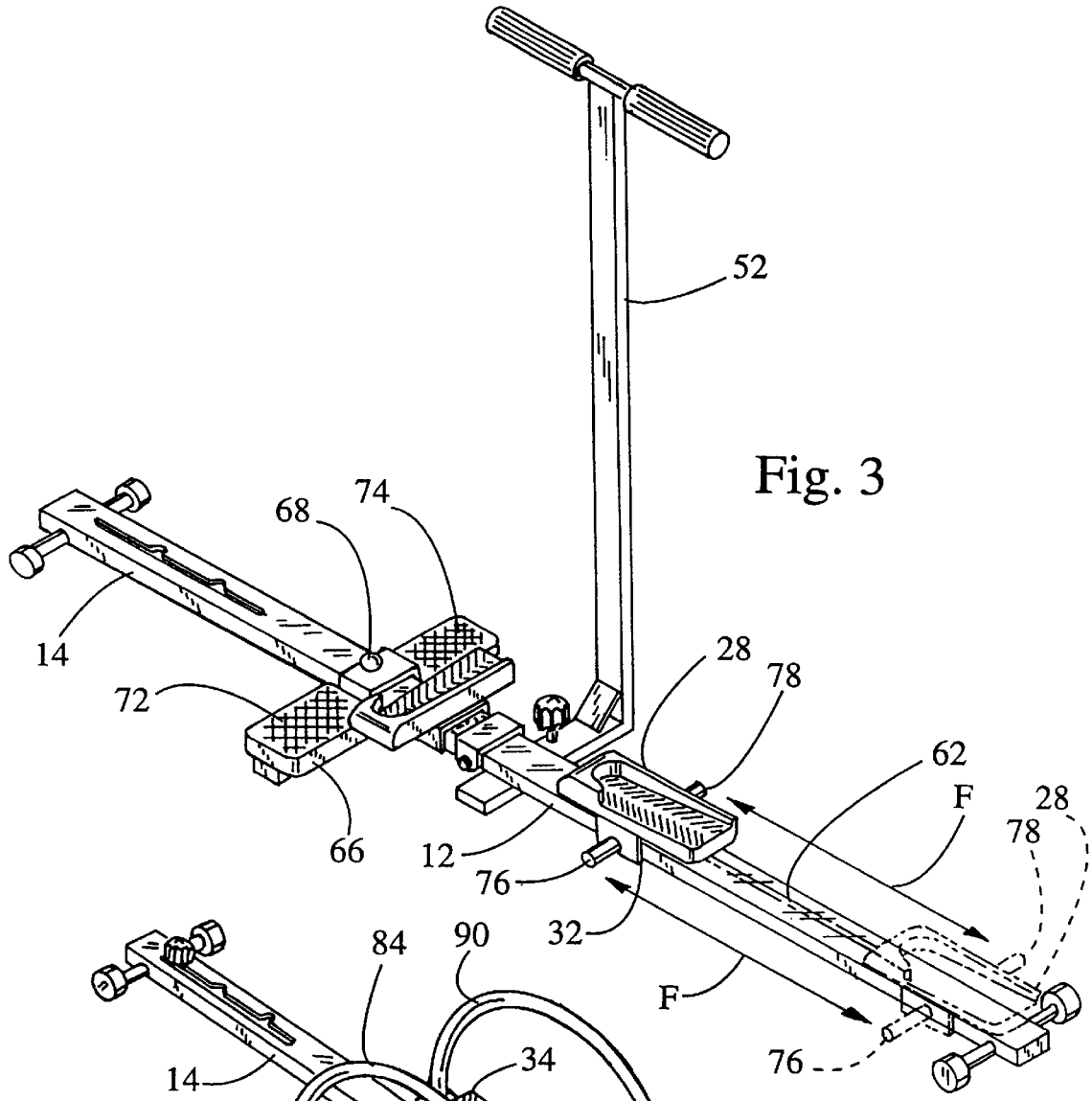
FIG. 3 is a perspective view of the hybrid stretching and exercise machine of FIG. 1 having a knee-rest attachment formed thereon to enable user to perform abdominal-strengthening exercises.

With reference now to FIG. 3, there is shown the machine 10 of the present invention as adapted to facilitate the performance of abdominal-strengthening exercises. As shown, the machine 10 further incorporates the use of a knee rest member 66 that is detachably fastenable to the second rail member 14. The knee rest member 66 is provided with first and second knee rest portions 72, 74 to accommodate the opposed knees of an individual. As illustrated on the first rail member 12, the foot-receiving member 28 is provided with first and second hand grips 76, 78 formed upon opposed sides of a slide mount 32 upon which is mounted the first foot-receiving member 28.

As discussed above, the handle members 76, 78 are biased inwardly towards the proximal end of the first rail member 12, but may be extended in a linear fashion across the first rail member 12 in the directions indicated by the letters F and F', when the user applies an opposing force exerted upon the handle 76, 78 against the biasing force imparted by the internally disposed elastic cord 62. In this regard, the foot-receiving apparatus 28, as well as handles 76, 78 formed thereon are selectively transitional between the first configuration shown towards the proximal end of the first rail member 12, and the second extended configuration shown in phantom toward the distal end of the first rail member 12.

Figure 5:
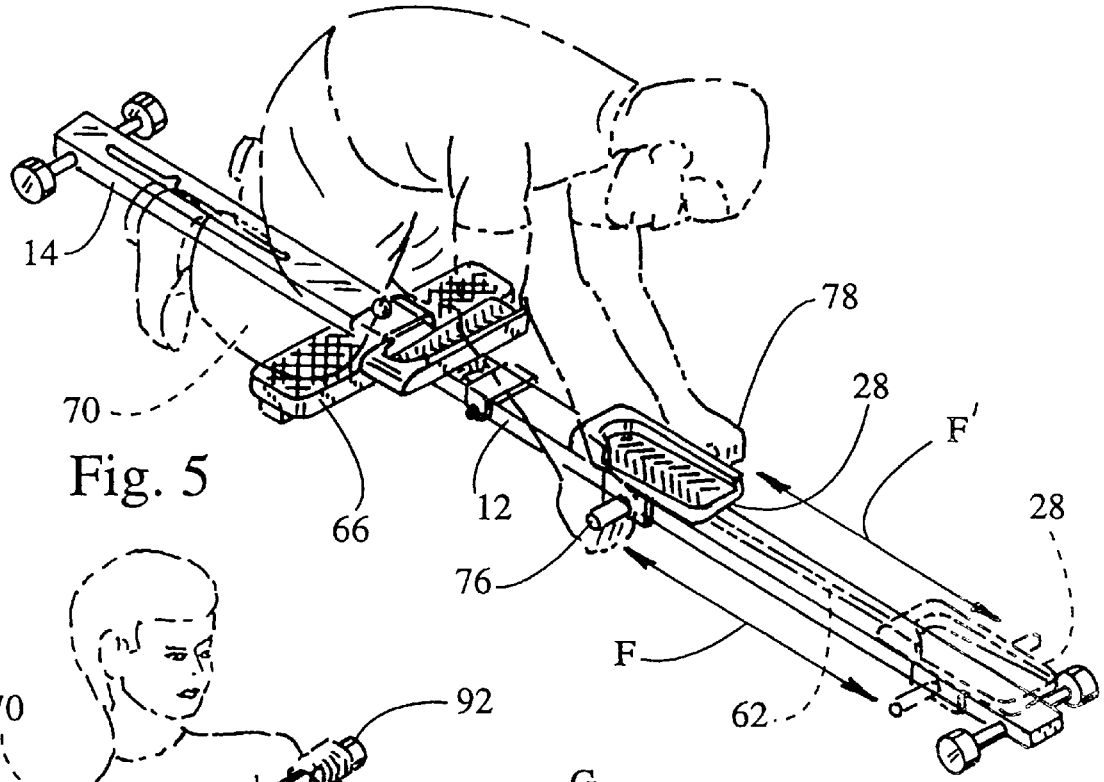
FIG. 5 is a perspective view of the hybrid stretching and exercise machine of FIG. 1 depicting an individual, and phantom, performing abdominal-strengthening exercises.

As illustrated in FIG. 5, to perform abdominal-strengthening exercises, the individual 70 need only position him or herself upon the device 10 such that the individual's knees rest respectively on the knee rest portions of the knee rest member 66. The user may thus grip the handle 76, 78 in advance in a forward direction against the biasing force such that the handle 76, 78 assume the second extended configuration, shown in phantom and retreat rearwardly to the biased position. By performing repetitious sets of such motions, the individual 70 will thus be caused to strengthen the muscle groups according to well-established exercise principals. As will be recognized by those skilled in the art, in order to perform such exercises, it may be necessary to remove handle member 52 from the machine 10 of the present invention.

Figure 6:
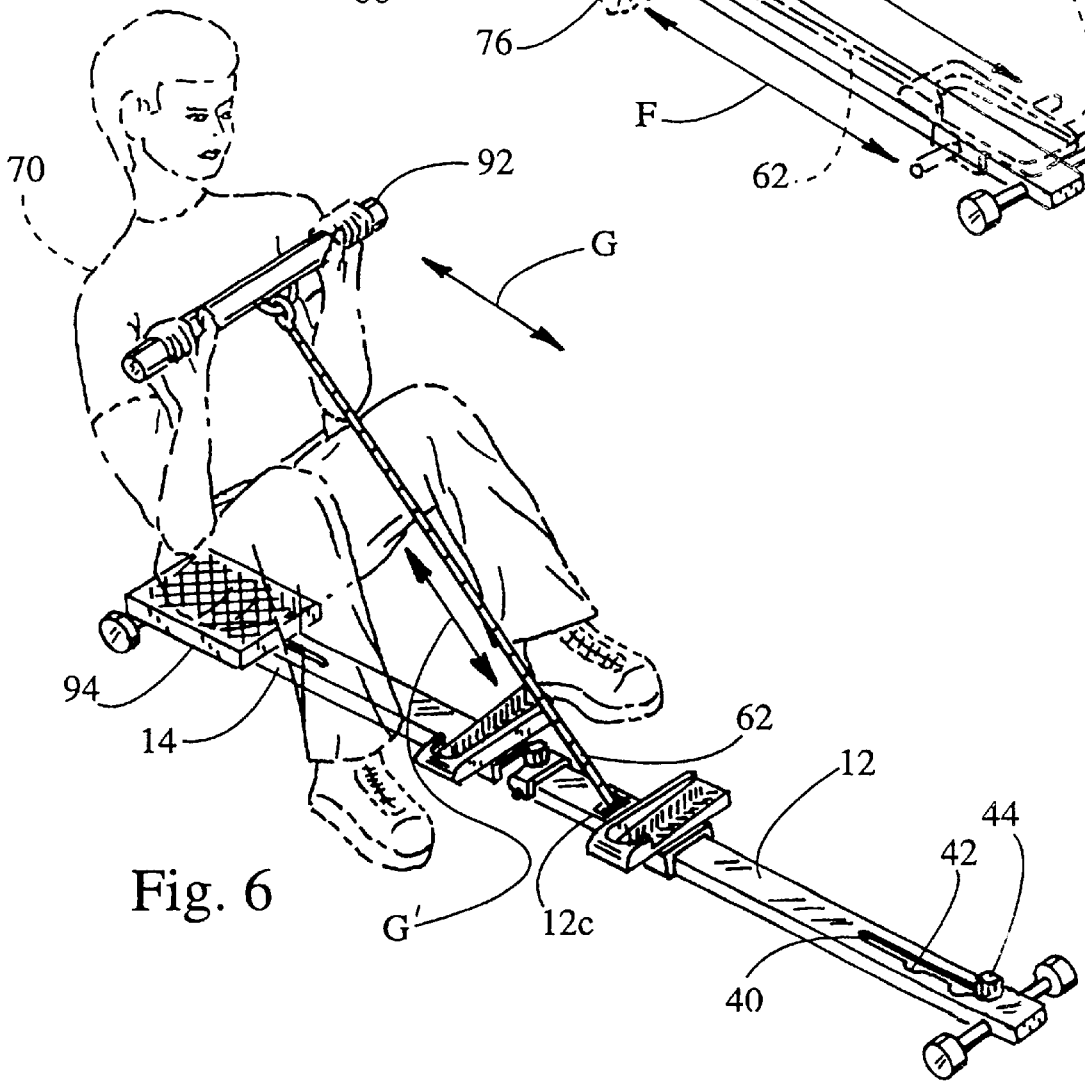
FIG. 6 is a perspective view of the hybrid stretching and exercise machine of FIG. 1 depicting an individual, and phantom, performing rowing-type exercises.

Referring now to FIG. 6, there is shown the individual 70 performing rowing-type exercises with the machine 10 of the present invention. To perform such exercises, the machine 10 of the present invention incorporates the use of a seat-rest member 94 which may be detachably fastened to the distal end of the second rail member 14. A handle member 92 is then affixed to the elastic cord 62 of the biasing mechanism disposed within the first rail member 12. As will be appreciated by those skilled in the art, when the individual is seated upon the seat rest 94 and grips handle member 92 in the manner shown, the individual may be able to engage in repetitious rowing-type motions by transitioning in the directions indicated by the letters G and G'.

Due to the biasing force imparted by the elastic cord 62 against the handle 92, the individual 70 is thus caused to experience muscle-strengthening exercises and cardiovascular conditioning, as per conventional rowing exercises. As will further be appreciated by those skilled in the art, due to the ability of the device to impart a desired degree of bias (i.e., tension) an elastic cord 62, via the manipulation of knob 44 disposed within aperture 40, a select tension may be applied to the elastic cord 62 to thus correspond with the degree of exertion to be made by the individual 70. Such selective degree of bias may further be utilized with respect to the abdominal-strengthening exercises discussed in reference to FIGS. 3 and 5.

Figure 7:
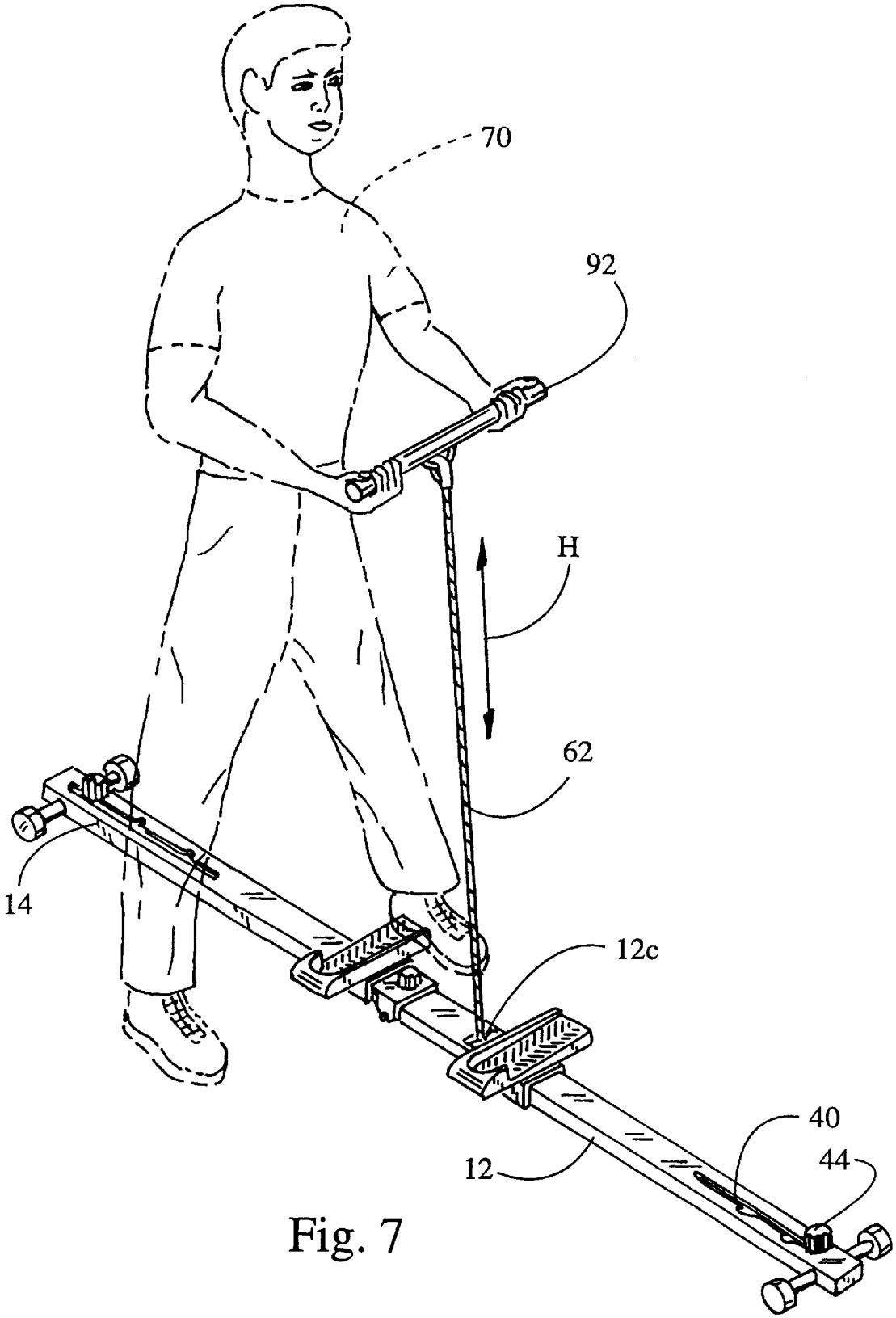
FIG. 7 is a perspective view of the hybrid stretching and exercise machine of FIG. 1 depicting an individual, and phantom, performing curl-type biceps strengthening exercises.

Referring now to FIG. 7, the machine 10 of the present invention is further shown being utilized by an individual to perform curl-type exercises. As it is well-known to those skilled in the art, such curl-type exercises are known to strengthen the muscles in the upper arms, and in particular the biceps muscles. As illustrated, the handle 92 may be grasped by the individual and pulled upwardly in the direction indicated by the letter H, as per conventional curl-type exercises. The bias in the elastic cord 62 thus creates a force against which the individual must pull, which in turn provides the strengthening activity.

Although the invention has been described herein with specific reference to a presently preferred embodiment thereof, it will be appreciated by those skilled in the art that various modifications, deletions, and alterations may be made to such preferred embodiment without departing from the spirit and scope of the invention. In this regard, it will be recognized in the embodiments discussed that the first rail member may be utilized interchangeably with the second rail member. Likewise, though there is depicted one particular biasing mechanism whereby the foot-receiving members 28, 34 and handle members 76, 78, and 92 are shown being biased towards the proximal end of a respective rail member, a variety of biasing members may be deployed that are known by those skilled in the art. For example, such biasing force may deploy elastic cords configured differently, as well as substitute thereinstead the use of springs, friction mechanisms, and the like. It will further be recognized that, as per conventional exercise devices, the machine 10 of the present invention may further include such conventional apparatuses as a timer or calorimeter to enable the user to time his or her workout, as well as monitor the progress made (i.e., calories consumed) during such workout. Accordingly, it is intended that all reasonably foreseeable additions, modifications, deletions and alterations be included within the scope of the invention as defined in the following claims.

What is claimed is:

1. A hybrid stretching and exercise machine comprising:

a) first and second elongate rail members having distal and proximal ends, said first and second rail members being arranged in a co-linear fashion such that the respective proximal ends thereof substantially abut one another;

b) a first foot-receiving member slidably and rotatably mounted upon said first track member and biased toward the proximal end thereof; and c) a second foot-receiving member slidably and rotably mounted upon said second track member and biased toward the proximal end thereof;

d) at least one first elastic cord for controlling the degree of bias of said first foot receiving member towards said respective proximal end of said first track member; and e) at least one second elastic cord for selectively controlling the degree of bias of the second foot-receiving member toward the proximal end of said second track member.

2. The hybrid stretching and excise machine of claim 1 further comprising:

d) a handle member disposed intermediate said first and second track members for facilitating use of said exercise device.

3. The hybrid stretching and exercise device of claim 2 wherein said handle member comprises an upright handle having at least one hand grip formed thereon.

4. The hybrid stretching and exercise device of claim 2 wherein said handle member comprises a pair opposed arcuate handle members disposed on opposed sides of said first and second track members.

5. The hybrid stretching and exercise device of claim 1 wherein said first and second foot-receiving members are detachably fastenable to said first and second track members.

6. The hybrid stretching and exercise device of claim 1 further comprising:

d) a knee cushion apparatus detachably fastenable to a respective one of said first and second track members;

e) a pair of hand grip members detachably fastenable to and slidably mountable upon a respective one of said first and second track member; and f) wherein said knee rest members are secured to a respective one of said first and second track members and said hand rest members are slidably mounted upon the respective other of said first and second track members, said exercise machine is operative to facilitate the performance of abdominal-strengthening exercises.

7. The hybrid stretching and exercise device of claim 1 further comprising:

a) a seat member detachably fastenable to a respective one of said first and second track members;

b) a handle member detachably fastenable to a respective one of said first and second track members, said handle member being biased toward the respective proximal end thereof; and c) wherein when seat member is secured to a respective one of said first and second track members and said handle member is secured to the respective other of said first and second track members, said exercise machine is operative to facilitate the performance of rowing-type exercises.

8. The hybrid stretching and exercise device of claim 1 further comprising a handle member having an elastic cord extending therefrom, said elastic cord being attachable to a respective one of the proximal ends of said first and second track members such that in use, when attached to a respective one of said first and second track members, said handle is operative to facilitate the performance of curl-type bicep strengthening exercises.

9. The hybrid stretching and exercise device of claim 1 wherein springs are substituted for said at least one first and second elastic cords.

10. A hybrid stretching and exercise machine comprising:

a) first and second elongate rail members having distal and proximal ends, said first and second rail members being arranged in a co-linear fashion such that the respective proximal ends thereof substantially abut one another;

b) a first foot-receiving member slidably and rotatably mounted upon said first track member;

c) a second foot-receiving member slidably and rotatably mounted upon said second track member;

d) a seat member detachably fastenable to a respective one of said first and second track member;

e) a handle member detachably fastenable to a respective one of said first and second track members, said handle member being biased toward the respective proximal end thereof; and f) wherein when seat member secured to our respective one of said first and second track members and said handle members secured to the respective other of said first and second track members, said exercise machine is operative to facilitate the performance of rowing-type exercises.

11. A stretching and exercise machine comprising:

a) first and second elongate rail members having distal and proximal ends, said first and second rail members being arranged in a co-linear fashion such that the respective proximal ends thereof are adjacent one another;

b) a first foot-receiving member slidably and rotatably mounted upon said first track member and biased toward the proximal end thereof;

c) a second foot-receiving member slidably and rotatably mounted upon said second track member and biased toward the proximal end thereof; and d) wherein said first and second foot-receiving members each respectively define a foot receiving surface that remains in substantially parallel relation to said track member as said foot receiving member extends along the rail member.

12. The stretching and exercise device of claim 11 further comprising:

a) a first biasing mechanism coupled to said first rail member for selectively controlling the degree of bias of said foot receiving member toward the proximal end of said first rail member; and b) a second biasing mechanism coupled to said second rail member for selectively controlling the degree of bias of said foot receiving member toward the proximal end of said second rail member.

13. The hybrid stretching and exercise device of claim 12 wherein said first and second biasing mechanisms comprise dedicated elastic cords having selectively adjustable lengths.

14. A stretching and exercise machine comprising:

a) first and second elongate rail members having distal and proximal ends, said first and second rail members being arranged in a co-linear fashion;

b) a first foot-receiving member slidably mounted upon said first track member and biased toward the proximal end thereof, said first foot-receiving member being operative to enable the foot of a user to freely rotate thereon;

c) a second foot-receiving member slidably mounted upon said second track member and biased toward the proximal end thereof, said second foot-receiving member being operative to enable the foot of a user to freely rotate thereon; and d) wherein said first and second foot-receiving members each define respective foot-receiving surfaces that remain in substantially parallel relation said track member as said foot receiving members extend along the respective rail members.

* * * * *